US008175480B2

(12) United States Patent
Seo et al.

(10) Patent No.: US 8,175,480 B2
(45) Date of Patent: May 8, 2012

(54) FIXING DEVICE INCLUDING PLURAL DEMAGNETIZING COILS AND IMAGE FORMING APPARATUS

(75) Inventors: Hiroshi Seo, Sagamihara (JP); Takamasa Hase, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 500 days.

(21) Appl. No.: 12/332,784

(22) Filed: Dec. 11, 2008

(65) Prior Publication Data

US 2009/0148205 A1 Jun. 11, 2009

(30) Foreign Application Priority Data

Dec. 11, 2007 (JP) ..... 2007-320012

(51) Int. Cl.
*G03G 15/20* (2006.01)

(52) U.S. Cl. ..... 399/67; 399/328; 399/334

(58) Field of Classification Search ..... 399/67, 399/69, 328, 329, 334; 219/619
See application file for complete search history.

(56) References Cited

U.S. PATENT DOCUMENTS

| | | | | |
|---|---|---|---|---|
| 6,373,036 | B2 * | 4/2002 | Suzuki | 219/619 |
| 7,005,619 | B2 * | 2/2006 | Fujii et al. | 219/619 |
| 7,764,916 | B2 * | 7/2010 | Kagawa | 399/334 |
| 7,856,190 | B2 * | 12/2010 | Kishi | 399/67 |
| 2002/0011485 | A1 | 1/2002 | Suzuki | |
| 2005/0067408 | A1 | 3/2005 | Fujii et al. | |
| 2007/0003334 | A1 | 1/2007 | Shinshi et al. | |
| 2007/0059003 | A1 | 3/2007 | Shinshi et al. | |
| 2007/0059011 | A1 | 3/2007 | Seo et al. | |
| 2007/0201913 | A1 | 8/2007 | Kamoda | |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0044196 | A1 | 2/2008 | Seo et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |

FOREIGN PATENT DOCUMENTS

| | | | |
|---|---|---|---|
| CN | 1154883 | C | 6/2004 |
| CN | 101030066 | A | 9/2007 |
| EP | 1 253 483 | A1 | 10/2002 |
| JP | 9-216619 | | 8/1997 |
| JP | 9-313714 | | 12/1997 |
| JP | 10-174814 | | 6/1998 |
| JP | 2001-60490 | | 3/2001 |
| JP | 2006-50106 | | 2/2006 |
| JP | 2007-79131 | | 3/2007 |

OTHER PUBLICATIONS

Chinese Office Action from corresponding Chinese Patent Application No. 200810177292 dated Mar. 9, 2011.

* cited by examiner

*Primary Examiner* — William J Royer
(74) *Attorney, Agent, or Firm* — Oblon, Spivak, McClelland, Maier & Neustadt, L.L.P.

(57) ABSTRACT

A fixing device includes a heat applying system having an exciting coil that creates a magnetic flux for generating induction heat in a heat generation layer provided in a fixing roller. Plural demagnetizing coils are stacked in plural layers partially overlying the exciting coil to cancel the magnetic flux at one end of the fixing roller. The plural demagnetizing coils partially overlap each other.

19 Claims, 7 Drawing Sheets

FIXING DEVICE INCLUDING PLURAL DEMAGNETIZING COILS AND IMAGE FORMING APPARATUS

CROSS REFERENCE TO RELATED APPLICATION

This application claims priority under 35 USC §119 to Japanese Patent Application No. 2007-320012, filed on Dec. 11, 2007, the entire contents of which are herein incorporated by reference.

BACKGROUND OF THE INVENTION

1. Field of the Invention

The present invention relates to a fixing device having a heat-applying device of an electromagnetic induction heat applying system, and in particular, to a fixing device and an image formation apparatus employing the fixing device.

2. Discussion of the Background Art

In an image forming apparatus, such as a copier, a printer, a facsimile, a duplicator, a multifunction machine of those, and the like, an image is created by transferring a toner image carried on a latent image carrier onto a recordation medium like a sheet. The toner image is fixed onto the recordation member due to an operation of melting and a penetration behavior of the toner subjected to heat and pressure when the toner image passes through a fixing device. As a heat applying system, a heat roller type fixing system that includes a heat-applying roller having a halogen lamp and a pressure-applying roller contacting the heat-applying roller is exemplified. Also exemplified is a film type fixing system employed to suppress calorie rather than a roller. A fixing device employing an electromagnetic heat applying system recently receives attention.

In such a system, an induction heat-applying coil is wound around a bobbin provided in a fixing roller or a heat-applying roller, and current is supplied thereto, so that over-current is generated in the heat-applying roller. As a result, the heat-applying roller is heated. In such a situation, a film can advantageously be heated directly while omitting after heat that is needed by the heat roller type fixing system, so that a prescribed temperature can immediately be obtained.

A high frequency induction heat applying apparatus including an induction heat-applying coil that receives a high frequency voltage from a high frequency power supply is known. In these days, a quick start is achieved by introducing a high frequency induction heat to a fixing device having a low calorie performance in accordance with demand of energy saving, so that a machine becomes quickly available to a user from when a power supply is turned on.

However, when a smaller size of a sheet than a prescribed heat application width is repeatedly fed though a fixing device of a low calorie type, since a sheet passage section releases the calorie to the sheet while a non-sheet passage section does not, temperature increases at the ends thereof. As a result, an image deteriorates or a lifetime of the fixing device decreases. Thus, it has been attempted to arrange a demagnetizing coil on an exciting coil so as to cancel a magnetic flux extending from the exciting coil as described in the Japanese Patent Application laid Open No. 2001-060490.

However, the technology of the Japanese Patent Application Laid Open No. 2001-060490 can only handle a limited number of definite shape sizes. Specifically, when a demagnetizing coil shape or size is determined to handle a post card size and a sheet larger than the same like B5 (Japanese Industrial Standard) is fed longitudinally while controlling a demagnetizing amount so that the maximum temperature can be less than a prescribed level at the non-sheet passage section, temperature decreases at the ends of the sheet.

As a result, a fixing performance is defective. Otherwise, brilliance becomes uneven for the same reason resulting in creating an uncomfortable image. That is, since a heat conducting cross section reduces in the fixing device and a heat flattening performance deteriorates in a direction in parallel to an axis of a rotation member, the above-mentioned problem becomes prominent. Further, since the temperature increases at both ends, an elastic member and a protecting film and the like arranged on the heat-applying roller can be damaged.

SUMMARY OF THE INVENTION

The present invention has been made in view of the above noted and other problems and one object of the present invention is to provide a new and noble fixing device.

Such a new and noble fixing device includes a heat applying system having an exciting coil that creates a magnetic flux for generating induction heat in a heat generation layer provided in a fixing roller. Plural demagnetizing coils are stacked in plural layers partially overlying the exciting coil to cancel the magnetic flux at one end of the fixing roller. The plural demagnetizing coils partially overlap each other.

In another embodiment, plural loop spaces formed in the plural demagnetizing coils are substantially not interfered by the other demagnetizing coils.

In yet another embodiment, the demagnetizing coils include not less than three demagnetizing coils, and two of them are stacked substantially at the same distance from the surface of the fixing roller.

In yet another embodiment, plural central core members are provided aligning on the same line in parallel to an axis of the fixing roller within the inner loop spaces of the plural demagnetizing coils. The central core members are made of magnetic material.

In yet another embodiment, the size of the loop spaces of the demagnetizing coils is different from each other.

In yet another embodiment, the demagnetizing coils are symmetrically arranged with respect to a widthwise center of the fixing roller. The demagnetizing coils are electrically connected to each other.

In yet another embodiment, a control device is provided to control calorie of the demagnetizing coils by adjusting an amount of power to be supplied.

In yet another embodiment, the control device includes a switching device for turning on and off the power.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
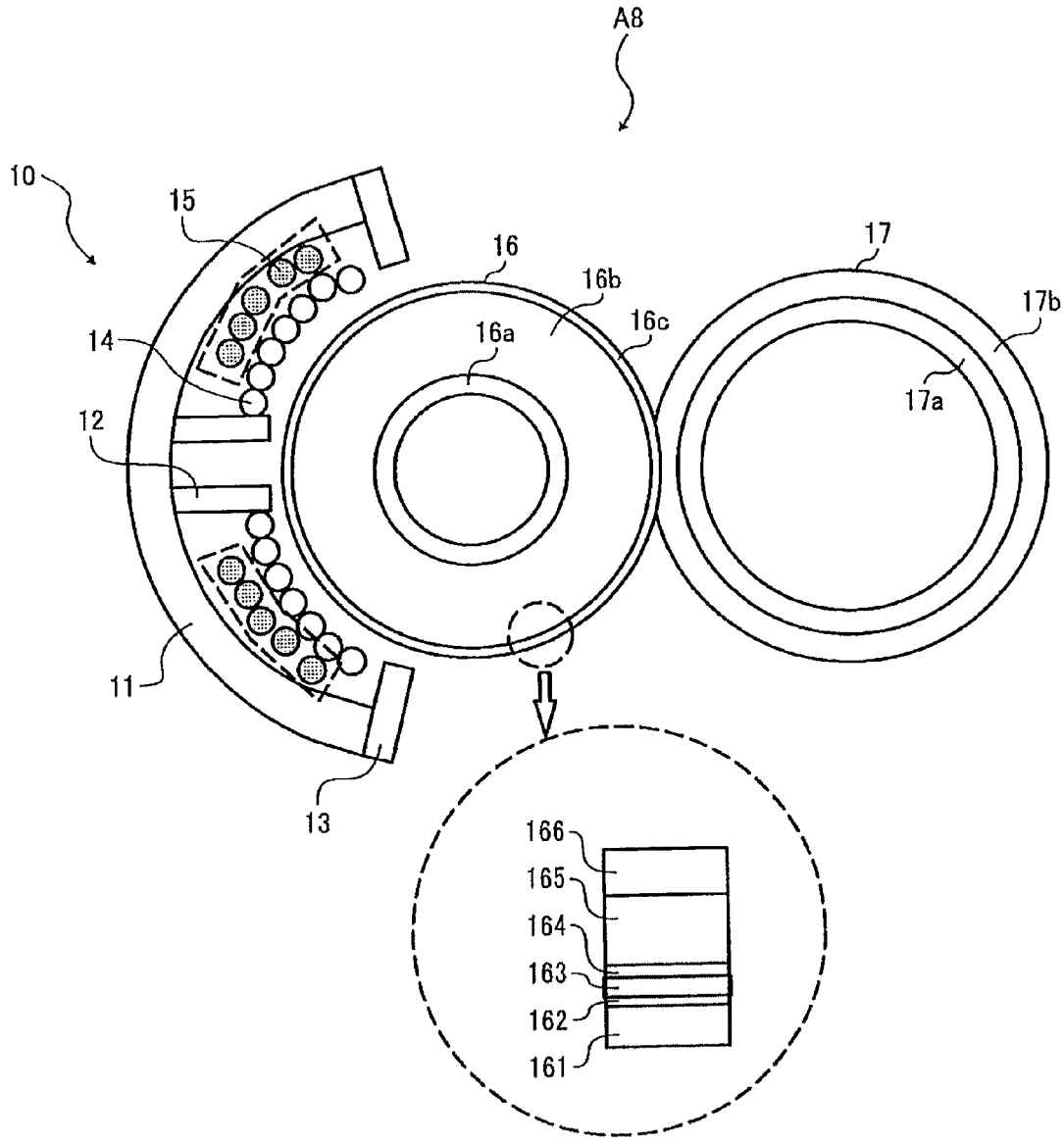
FIG. 1 is a cross sectional view illustrating a conceptual configuration of an exemplary fixing device according to one embodiment of the present invention.

Referring now to the drawings, wherein like reference numerals and marks designate identical or corresponding parts throughout several figures, in particular in FIG. 1, an exemplary fixing device according to one embodiment of the present invention is described.

As shown, the fixing device A8 includes a heat applying member 10 having an exciting coil 14 serving as a magnetic flux generation device and a fixing roller 16 serving as a heating rotation member, and a pressure applying roller 17 serving as a pressure applying rotation member. The fixing device A8 generates a high frequency magnetic field when the exciting coil 14 is driven at high frequency by an inverter, not shown, arranged therein. Thus, current flows through a heating layer provided in the fixing roller 16 and raises temperature thereof in the magnetic field. A pair of side cores 13 are arranged at both upper and lower sides of the heat applying member 10, extending in both directions in parallel and perpendicular to an axis of the fixing roller 16. A pair of center cores 12 having a cross section of a rectangular shape are also arranged at the middle height of the heat applying member 10 at a prescribed interval, extending in parallel to an axis of the fixing roller 16. Plural arch cores 11 are intermittently arranged in parallel to an axis of the fixing roller 16 at a prescribed interval. The exciting coil 14 is positioned between the arch cores 11 and the fixing roller 16.

The fixing roller 16 includes a metal core 16*a* made of stainless steel and an elastic member 16*b* made of silicone rubber wrapping the metal core 16A having heat resistance in solid or foamed state. An outer diameter of the fixing roller 16 is about 40 mm. A contact section having a prescribed width is formed between the pressure-applying roller 17 and the fixing roller 16 when pressure is applied from the pressure-applying roller 17.

The elastic member 16*b* has a thickness of from about 0.5 to about 30 mm and a hardness of from about 20 to about 80-degree (JIS K 6301 Hardness). Thus, since calorie decreases, the fixing roller 16 is quickly heated up so that a warm up time decreases.

The pressure-applying roller 17 includes a metal core 17*a* having high heat conductivity made of copper or aluminum, not shown, and an elastic member 17*b* wrapping the metal core 17*a* having a high heat resistance and a high toner releasing performance. A SUS can be used for the metal core 17*a*. Because of being harder than the fixing roller 16, the pressure-applying roller 17 bites into the fixing roller 16, so that a recordation medium (i.e., a sheet) can readily be separated from the surface of the pressure-applying roller 17. That is, the recordation medium goes along a circular shape of the surface. Even though the outer diameter of the pressure applying roller 17 is about 40 mm as same as that of the fixing roller 16, the thickness is smaller than that of the fixing roller 16 to be from about 0.3 to about 20 mm. The pressure-applying roller 17 is harder than the fixing roller 16 to be from about 10 to 70 degree (JIS K 6301 Hardness) as mentioned above.

The induction heat-applying device 10 that heats up the fixing roller 16 by means of electro-magnetic induction includes the exciting coil 14 serving as a magnetic field generation device and plural arch cores 11. Each of the arch cores 11 is semi cylindrical and is directly arranged in the vicinity of the outer circumferential surface of the fixing roller 16. The exciting coil 14 is formed by winding a long wire rod back and forth along the arch cores 11 in parallel to the fixing roller 16. The exciting coil 14 is connected to a driving power supply having a vibration circuit capable of changing a frequency. In the vicinity of the outside of the exciting coil 14, plural center cores 12 made of strong magnetic members such as ferrite extend in both directions in parallel and perpendicular to an axis of the fixing roller 16 while being firmly secured to the arch cores 11. The center cores 12 have a relative magnetic permeability of about 2500. The exciting coil 14 is supplied with a high frequency alternating current of from 10 kHz to 1 MHz, preferably from 20 to 800 kHz, from the driving power source. Then, the alternating magnetic field affects a heat generation layer 163 arranged in the vicinity of the contact region on the fixing roller 16, so that over current flows therethrough in a direction against that of a change of the alternating magnetic field.

The over current causes joule heat in accordance with a resistance of the heat generation layer 163, so that electro-magnetic heat is mainly applied to the contact region and surroundings of the fixing roller 16.

The fixing roller 16 has a diameter of about 40 mm and installs a metal core 16*a* at a rotational center, an elastic member or heat insulation layer 16*b* having a sponge member wrapping the metal core 16*a*, and a surface layer 16*c* having all of a substrate member 161, an oxidation prevention layer 162, the heat generation layer 163, an oxidation prevention layer 164, an elastic layer 165, and a releasing layer 166. The metal core 16*a* includes an iron or SUS of alloy with the iron. The heat insulation layer 16*b*has a thickness of about 9 mm. For example, SUS having a thickness of 50 micrometer, a nickel strike thin coat having a thickness less than about 1 micrometer, a Cu thin coat having a thickness about 15 micrometer, silicone rubber having a thickness of about 150 micrometer, and PFA having a thickness of about 30 micrometer are employed in the substrate member 161, the oxidation prevention layers 162 and 164, the heat generation layer 163, the elastic layer 165, and the releasing layer 166, respectively.

Figure 2A:
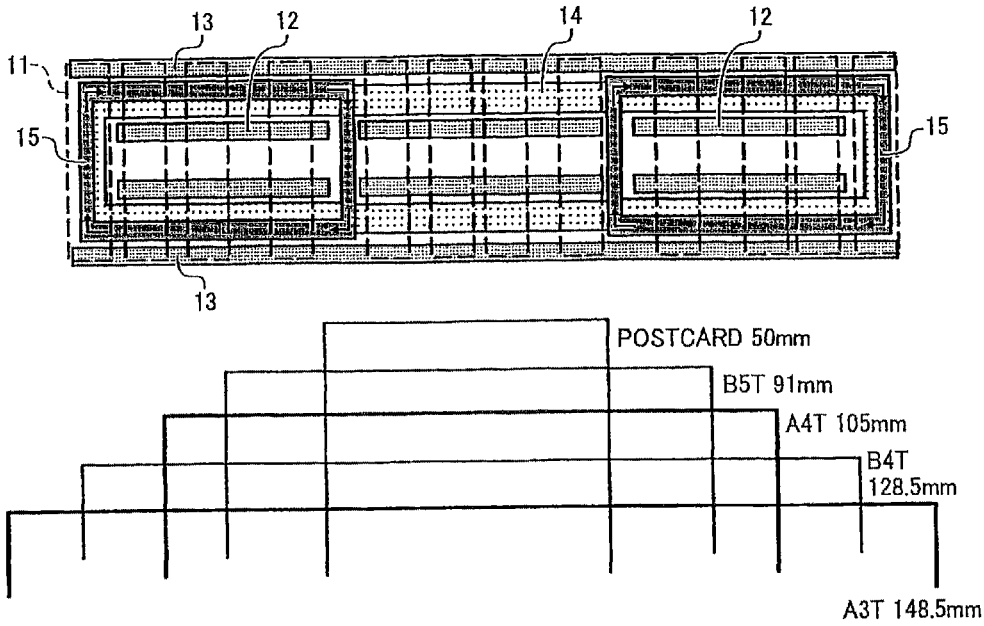
FIG. 2A PRIOR ART
FIGS. 2A and 2B collectively illustrate distribution of temperature in a direction in parallel to an axis of a fixing roller when a conventional fixing device of an induction heat applying system is used.
Figure 2B:
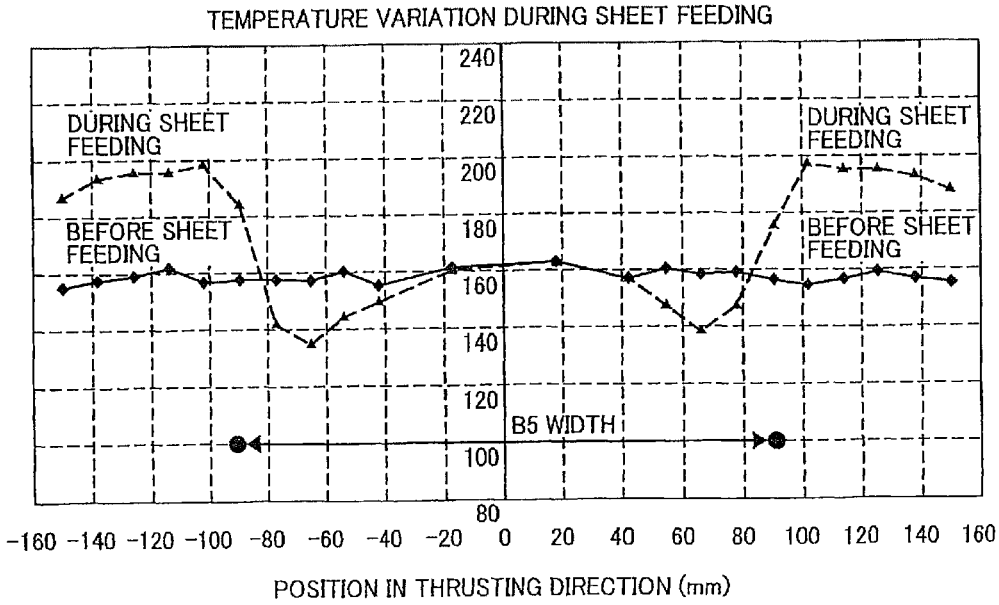

FIGS. 2A and 2B illustrate an exemplary temperature distribution in an axis direction of the fixing roller 16 when a conventional fixing device employing an induction heating system is used, wherein a dotted line represents the arch cores 11. In a fixing device A8 with low heat capacity, a sheet absorbs calorie of a sheet passage section and a non-sheet passage section is not absorbed. Thus, when a sheet having a smaller width than that of a valid heat application width is consecutively fed, the surface temperature increases at the ends of the fixing device A8 resulting in poor image and short lifetime due to high temperature there.

When the valid heat application width of the fixing device A8 handle the A3 sheet longitudinally fed and plural B5 sheets are practically fed longitudinally while detecting temperature of the fixing roller 16 along the axis direction of the fixing roller 16, temperature distribution is obtained as shown in the drawing. Specifically, the temperature is about 160 centigrade and is flat before sheet feeding, and is about 130 centigrade at both regions within 60 to 70 mm from the center as the lowest after the sheet feeding. Thus, the temperature causes defective fixation of toner or a low quality image with less brilliance in a color image after the sheet feeding. At that time, the temperature increases to a level from about 180 to about 200 centigrade at outsides of the B5 sheet on the fixing roller 16.

Further, when a lot of sheets are fed, the temperature sometime becomes about 300 centigrade at the ends of the fixing roller 16. As a result, the elastic layer 165 made of silicone and the releasing layer 166 peel off, so that the fixing roller 16 is damaged. Accordingly, fine temperature control is needed in view of not only a high quality image but also a long lifetime of a machine.

Figure 3:
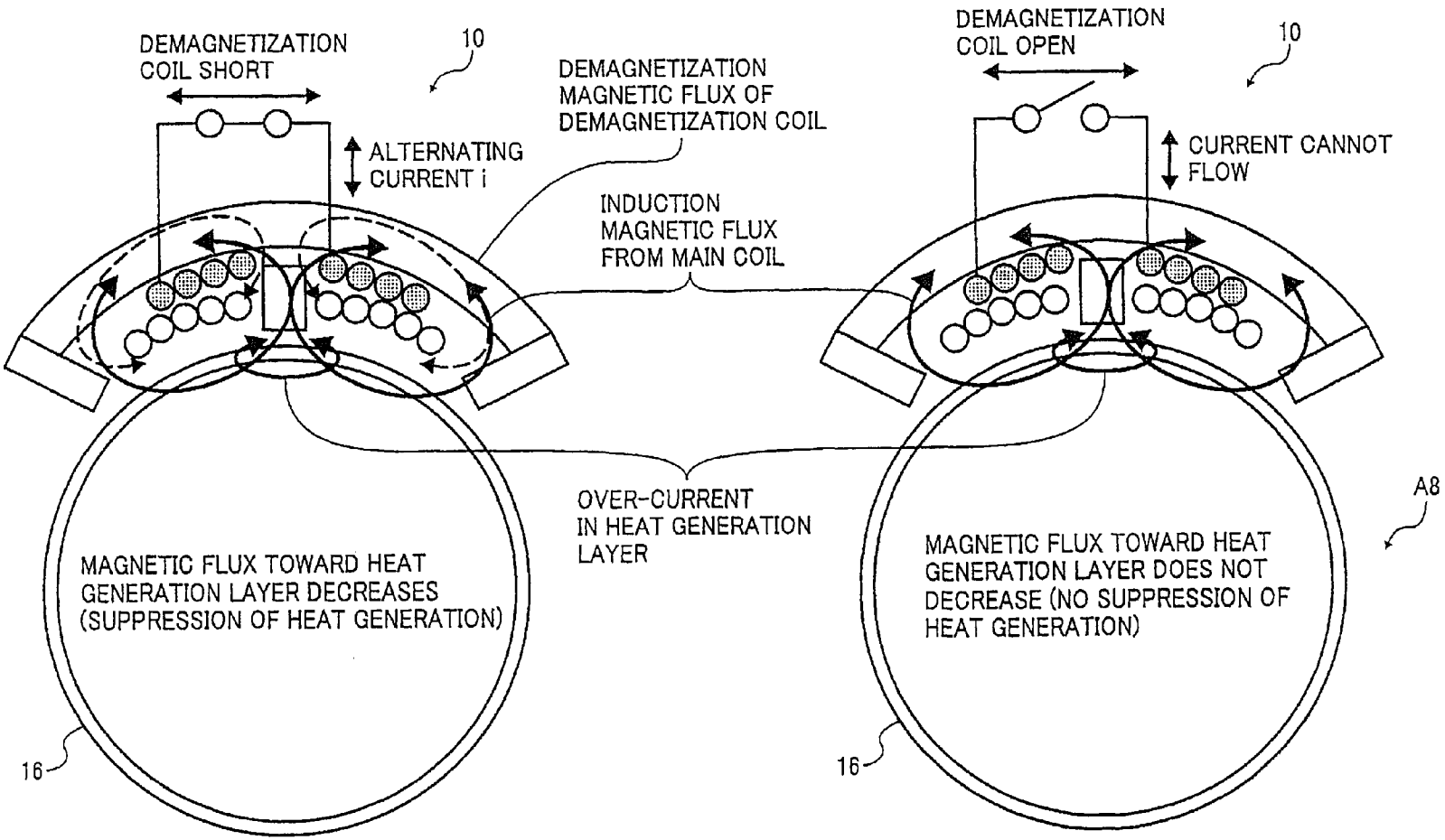
FIG. 3 schematically illustrates an exemplary heat-applying device according to one embodiment of the present invention.

An exemplary function of a heat applying member 10 is now described with reference to FIG. 3, wherein in exemplary effect of a demagnetizing coil 15 arranged on the exciting coil 14 is illustrated when power is turned on and off. As shown, a cross section of the fixing roller 16 is illustrated, and a relatively larger solid line arrow represents an induction magnetic flux created by the exciting coil 14, whereas a relatively smaller solid line represents over current flowing through the heat generation layer 163. The exciting coil 14 is controlled to generate the induction magnetic flux. Due to the induction magnetic flux, the over current is induced in the heat generation layer 163, so that the heat generation layer 163 generates heat. At this moment, a switch of the demagnetizing coil 15 is open as shown in the left side chart and does not create the magnetic flux. Then, a magnetic flux is created in an opposite direction as shown by a dotted line in the right side chart when the demagnetizing coil 15 is shorted. When the induction current flows through the demagnetizing coil 15 so as to cancel the exciting magnetic flux, the over current is suppressed in the heat generation layer 163. By switching in this way, a heat amount generated in the heat generation layer 163 can be controlled.

Now, the first embodiment is described with reference to FIG. 4. As shown, plural loops arranged on the exciting coil 14 typically illustrate demagnetizing coils 15. The uppermost chart illustrates a condition of overlapping of the exciting and demagnetizing coils 14 and 15 in a direction Z, wherein the arch cores 11 are omitted. The lower chart illustrates a plan view of such overlapping. The arch cores 11 are shown by dotted lines in the plan view. As shown, the demagnetizing coils 15 have a different size from the other, and are arranged on the exciting coil 14 in accordance with a heat application width while forming more than two steps in the direction Z. The demagnetizing coils 15 are aligned at one side end being partially overlapped on their sides with each other.

However, each of inner loop spaces 15*a* formed inside the demagnetizing coils 15 and a right or left side of the other demagnetizing coil 15 are arranged avoiding overlap with each other. Because, when the other demagnetizing coil 15 even partially enters the inner loop space in the demagnetizing coil 15, a smooth flow of a demagnetizing magnetic flux is disturbed, so that it does not reach the heat generation layer 163 thereby deteriorating efficiency of temperature control. Thus, with prescribed one or more demagnetizing coils 15, more precise heat generation width control can be realized in an axis direction of the fixing roller 16 in accordance with a size of respective sheets. The demagnetizing coils 15 can be wound by a prescribed times less than that of the exciting coil 14. The above-mentioned (magnetic substance) center cores 12 are omitted at positions in which the loops of the exciting and demagnetizing coils 14 and 15 overlap in the direction z with each other.

However, by aligning the demagnetizing coils 15 of the different size at one side end as shown, the omission of the center cores 12 can be suppressed to the minimum.

The center cores 12 smoothen the flow of the demagnetizing flux due to the magnetic substance so that the demagnetizing flux can effectively reach the heat generation layer 163.

Thus, fine temperature control can be achieved in the thrust direction of the fixing roller 16. The fatness (or the size) of the demagnetizing coil 15 is not the same to each other as shown. Specifically, since a difference of a width between the neighboring sheets varies in accordance with combination of neighboring sheets, the fatness of the coils is differentiated so as to control temperature in accordance therewith. Thus, the coils necessarily imperfectly overlap each other. In any way, by using and partially overlapping more than two steps of the demagnetizing coils 16 in the direction Z, temperature of the fixing roller 15 can be controlled in accordance with the size of the sheets.

Now, the second embodiment of the present invention is described with reference to FIG. 5. As shown, a plurality of demagnetizing coils 15 having substantially the same size are arranged stepwise such that inner loop spaces 15*a* formed in the demagnetizing coils 15 are not interfered by the other demagnetizing coils 15. For this purpose, the demagnetizing coils 15 are downsized in accordance with the size of the sheet and are partially overlapped with each other in the direction Z on a left or right side thereof. Thus, a coil unit of the demagnetizing coils 15 and the exciting coil 14 does not grow mammoth in the direction Z (i.e., perpendicular to the demagnetizing coil 15 winding surface).

Further, it is effective to arrange the center cores 12 in the inner loop spaces 15*a*, because demagnetization of the exciting magnetization flux is more effective. Although the center cores 12 are largely omitted, the heat distribution can be optimized if the demagnetizing coils 15 are preferably shaped and sized.

Figure 6:
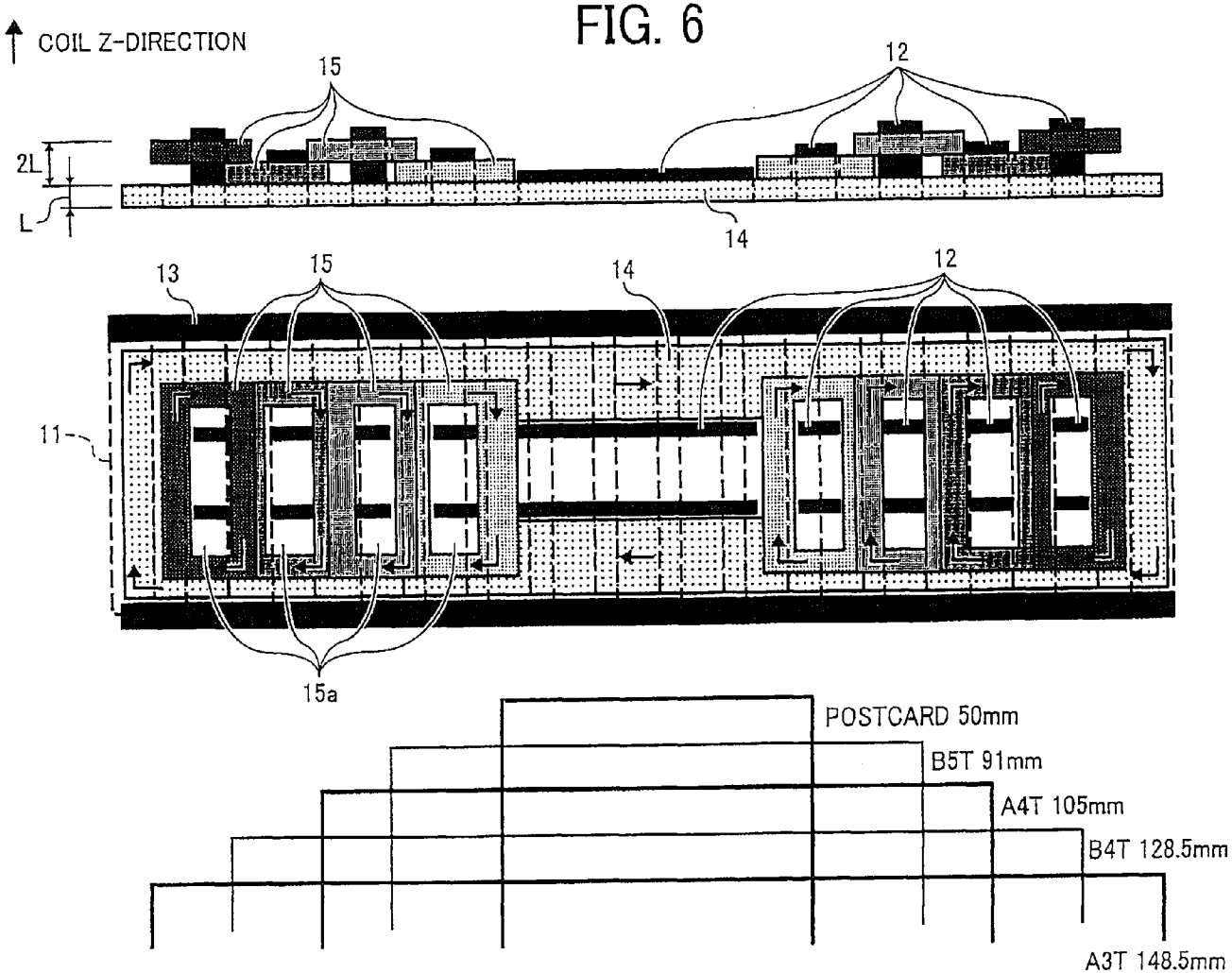
FIG. 6 schematically illustrates a third embodiment of the present invention.

Now, the third embodiment of the present invention is described with reference to FIG. 6. As described in the first and second embodiments, a height of the coil unit grows mammoth in proportion to a number of stacked demagnetizing coils 15.

Figure 4:
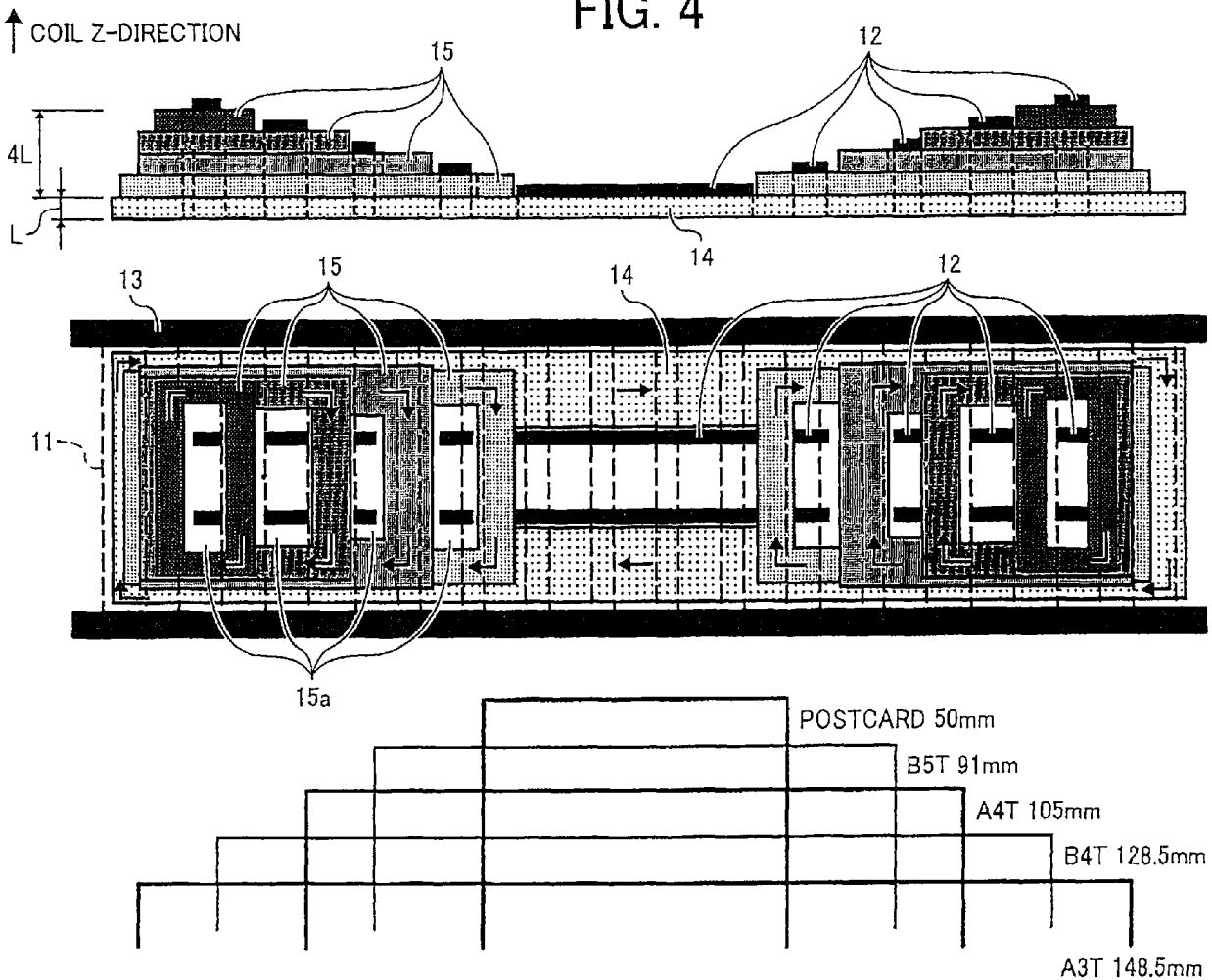
FIG. 4 schematically illustrates a first embodiment of the present invention.
Figure 5:
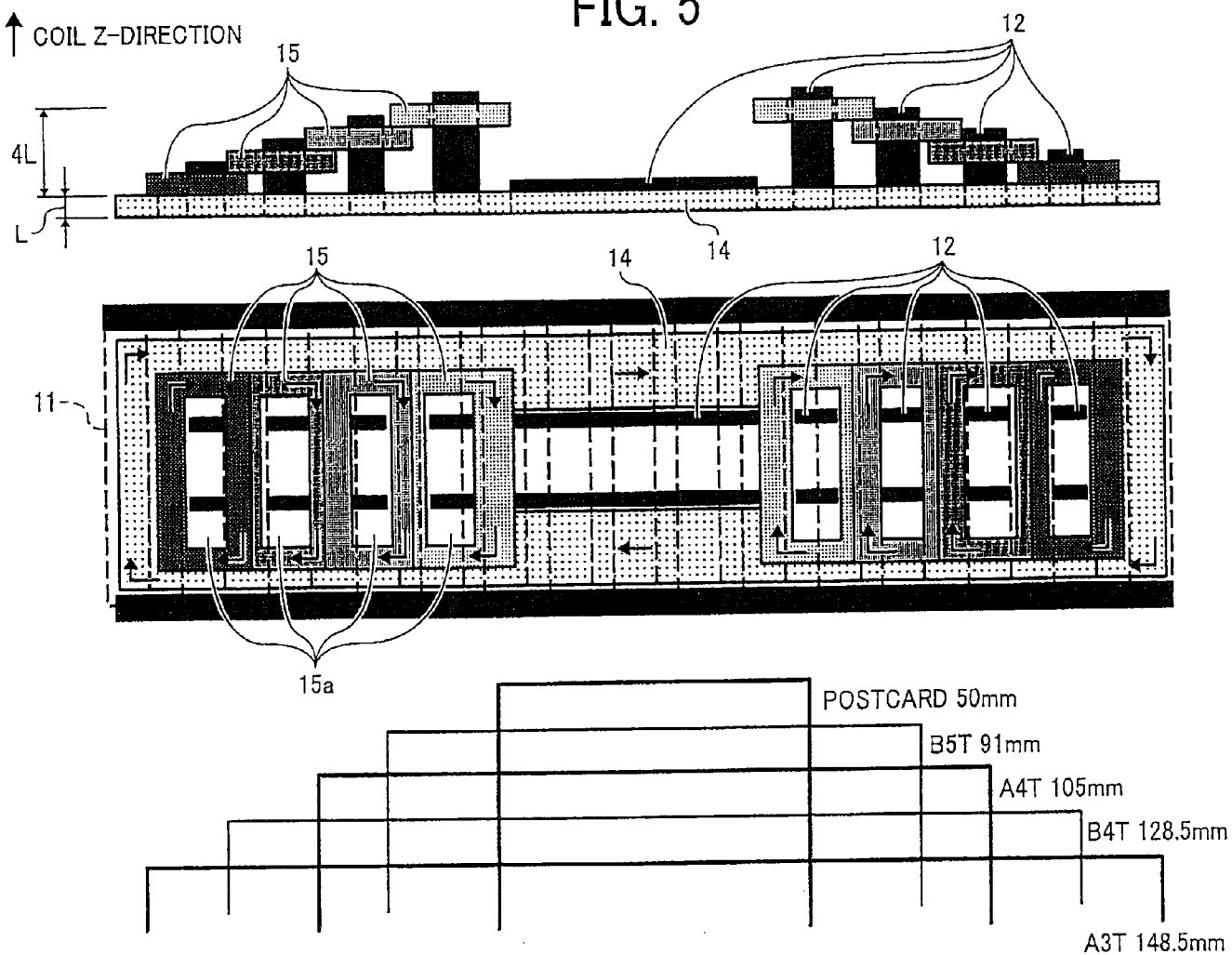
FIG. 5 schematically illustrates a second embodiment of the present invention.

Specifically, as shown in FIGS. 4 and 5, four steps of demagnetizing coils 15 are provided. As the height increases, the heat applying member 10 and accordingly the fixing device A8 becomes larger in proportion thereto resulting in disadvantage to machine designing.

Then, according to the third embodiment, plural demagnetizing coils 15 having substantially the same size are staggered on an exciting coil 14 being partially overlapped with each other on right or left sided thereof in the direction z, while avoiding the inner loop spaces 15*a* of the demagnetizing coils 15 from being interfered by the other demagnetizing coils 15.

Specifically, at least three layers are partially overlapped with each other while at least two of them are arranged in the direction Z at substantially the same distance. Specifically, the demagnetizing coils 15 are stacked partially overlapping each other in two stages as shown in FIG. 6.

Thus, mammoth growing of the heat-applying member 10 can be suppressed. Although the center cores 12 are omitted from sections in which the demagnetizing and exciting coils 15 and 14 overlap each other, since the demagnetizing coils 15 are stacked being partially overlapped in the direction z, the amount of omission of the center cores 12 can be suppressed to the minimum.

Further, the demagnetizing coils 15 are substantially symmetrically arranged in regard to a widthwise center of the fixing roller 16. Each of the symmetrically arranged demagnetizing coils 15 creates an amount of demagnetizing power for canceling an exciting magnetic flux based on a phase control of demagnetizing current induced by a power supply, current amount control executed by a semiconductor switch, or open/close ratio control of a mechanical switch. The symmetrically arranged demagnetizing coils 15 are electrically connected to each other and are driven by one common circuit. A prescribed one of the plurality of demagnetizing coils 15 is preferably selectively driven in accordance with the width of a sheet while a temperature sensor is arranged at a position corresponding to the demagnetizing coil 15 to execute temperature feedback control.

Further, the plural demagnetizing coils 15 can be driven either by a common device or different devices.

For example, when the heat generation layer 163 is provided in the fixing roller 16 and same speed printing is executed, the fixing roller 16 is rotated at a line speed of about 230 mm/sec, and demagnetizing control is executed during temperature control executed by the exciting coil 14.

However, a time when demagnetizing control is executed is not limited thereto.

Further, the fixing device A8 can include a fixing belt type system, wherein a fixing belt includes a heat generation layer, or is suspended and wound around a heat applying roller and a fixing rotation member.

Figure 7:
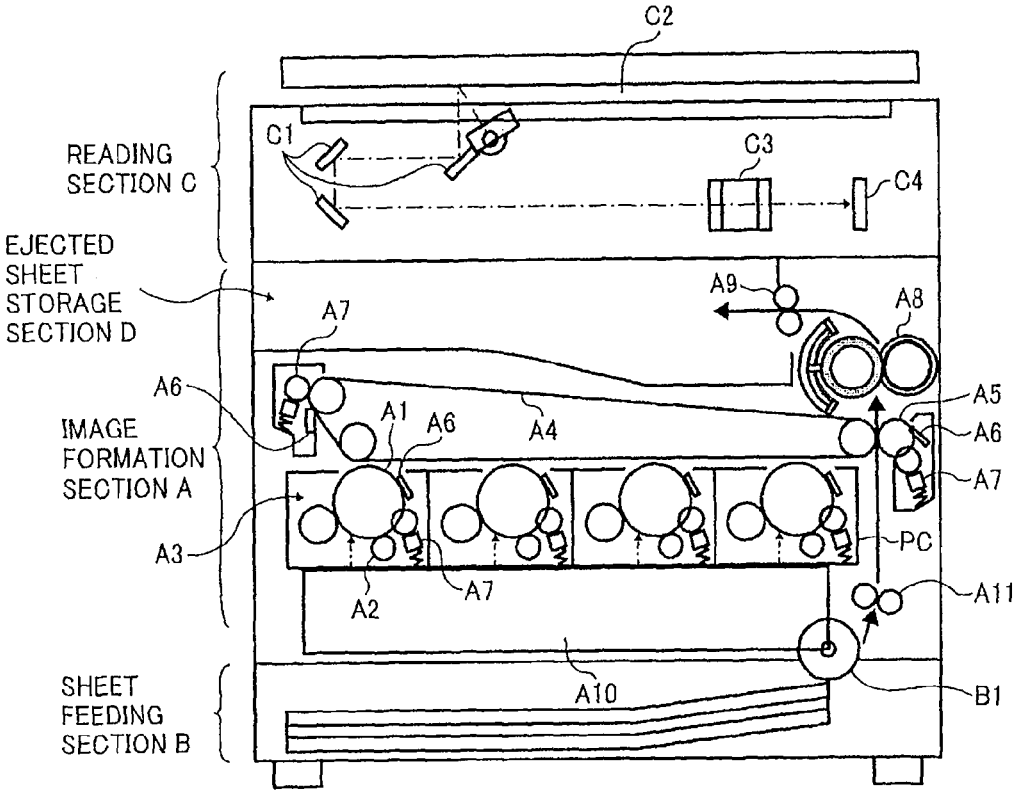
FIG. 7 schematically illustrates the entire configuration of an exemplary image forming apparatus employing the fixing device according to another embodiment of the present invention.

An exemplary configuration of an image forming apparatus of an inside sheet ejection type according to one embodiment of the present invention is described with reference to FIG. 7.

An image formation section A is arranged almost at the middle of the image forming apparatus. A sheet feeding section B is arranged right below the image formation section A. Another sheet feeding device can be additionally employed on the bottom upon need. Above the image formation section A, a reading section C for reading an original document is arranged via an ejected sheet storage section D onto which sheets as recordation mediums are ejected. An arrow in FIG. 7 represents a sheet path. Around a drum type photo-conductive member A1 in the image formation section A, there are provided a charge device A2 for charging the surface of the photo-conductive member A1, an exposure device A10 for emitting a laser light to the surface of the photo-conductive member A1, and a developing device A3 for visualizing a latent image formed on the surface of the photo-conductive member A1 . Also provided are an intermediate transfer device A4 for superimposing toner images carried on the plural photo-conductive members A1, a transfer device A5 for transferring the toner image onto the sheet, and a cleaning device A6 for removing and collecting toner remaining on the surface of the photo-conductive member after a transfer process. Further provided are a lubricant coating device A7 for decreasing friction coefficient of the surface of an image bearer such as a photo-conductive member A1, and a fixing device A8 arranged downstream of a conveyance path for conveying the sheet so as to fuse toner on the sheet with the toner image. To ease maintenance, the photoconductive member A1, the charge device A2, the developing device A3, the cleaning device A6 or the like are integrated as a unit of a process cartridge detachable from an apparatus body. For the same reason, the cleaning device A6 and the lubricant coating device A7 are integrated as a unit detachable from the intermediate transfer device A4.

Similarly, the cleaning device A6, the lubricant coating device A7, and the transfer device A5 are integrated as a unit detachable from the intermediate transfer device A4. The sheet passing through the fixing device A8 is ejected onto the ejected sheet storage section D via a sheet ejection roller A9.

In the sheet feeding section B, virgin sheets are accommodated and the topmost sheet thereof is launched by rotation of a sheet-feeding roller B1 from a sheet-feeding cassette toward a registration roller A11. The registration roller A11 is controlled to temporarily stop the sheet and then times and restarts rotating so that its leading end is located at a prescribed position to synchronize with the toner image on the surface of the photoconductive member A1. In the reading section C, to execute reading and scanning of an original document set onto a platen glass C2, a reading carriage member C1 having an original document illumination use light source and a mirror reciprocates in predetermined directions. Image information obtained by such scanning of the carriage C1 is read as an image signal by a CCD C4 arranged on the rear side of a lens C3. The image signal is then digitized and subjected to image processing. Based on a signal obtained after the image processing, a latent image is formed on the surface of the photoconductive member A1 by means of light emission, not shown, of a laser diode of the exposure device A10. An optical signal from the laser diode arrives at the photoconductive member A1 via a well-known polygon mirror and lenses.

The charge device A2 mainly includes a charge member and a bias member for biasing the charge member toward the photoconductive member A1 with a prescribed amount of pressure. The charge member includes a conductive layer around a conductive shaft thereof. A voltage-applying device, not shown, applies a prescribed voltage between a conductive elastic layer and the photoconductive member A1 via the conductive shaft, so that an electric charge is applied to the surface of the photoconductive member A1. In the developing device, a stirring screw sufficiently stirs developer and adheres the developer to a developing roller. A developing doctor then makes the developer into a thin layer on the developing roller. The thin layer then visualizes a latent image on the photoconductive member A1. The visualized toner image then electrically adheres to the intermediate transfer belt under control of a transfer bias roller. Toner not transferred and remained on the intermediate transfer belt is removed therefrom by a cleaning device A6. The lubricant coating member is a roller state and includes a metal shaft and a brush winding around the metal shaft. A solid lubricant is biased by its own gravity to the lubricant coating member. The solid lubricant is shaved off into a powder state when the lubricant coating member is rotated and is coated to the surface of the photoconductive member A1. At this moment, almost the entire surface of the photoconductive member A1 wider than a valid cleaning region receives coating of the lubricant therefrom. Because, since the valid cleaning region is determined by a cleaning performance or the like, the lubricant needs to be coated to the entire region that the cleaning blade contacts.

The lubricant-coating device A7 and the cleaning device A6 collectively form a transfer cartridge integrally installed in a casing. The solid lubricant is biased to the lubricant coating member having a brush roller by a bias member at a prescribed amount of pressure. Due to rotation of the lubricant coating member, the solid lubricant is shaved off therefrom and is coated to the surface of the intermediate transfer device A4. The cleaning device A6 includes a cleaning use brush roller and a cleaning blade, and is arranged upstream of the intermediate transfer device A4. The brush roller rotates in the same direction as the intermediate transfer device A4 and spreads alien substance on the surface. The cleaning blade pressure contacts the intermediate transfer device A4 at a prescribed angle and pressure to remove toner remaining on the intermediate transfer device A4. The cleaning device A6 and the transfer member collectively form a transfer cartridge integrally installed in a casing. As shown, the cleaning device A6 is arranged to remove toner remaining on the transfer member.

As the solid lubricant, dried solid hydrophobic nature lubricant can be used. Specifically, in addition to zinc stearate, material having stearic acid group, such as barium stearate, lead stearate, iron stearate, nickel stearate, cobaltic stearate, copper stearate, strontium stearate, calcium stearate, cadmium stearate, magnesium stearate, and the like, can be used. Further, the same fatty acid group, such as zinc oleate, manganese oleate, iron oleate, cobaltic oleate, lead oleate, magnesium oleate, copper oleate, palmistic acid, zinc cobalt palmistic acid, copper palmistic acid, magnesium palmistic acid, aluminum palmistic acid, calcium palmistic acid, and the like, can be used. Further, fatty acid, such as caprylic acid, lead caprylic acid, zinc linolenic acid, cobaltic linolenic acid, calcium linolenic acid, cadmium ricolinolenic acid, and the like, and metallic salt of fatty acid can be used. Still further, wax, such as candelilla wax, carnauba wax, rice wax, Japan wax, jojoba oil, beeswax, lanoline, and the like, can be used.

Now, an exemplary operation for forming a full color image with the above-mentioned construction is described. Plural images are formed on the lower side surface of the sheets so that the page of the sheets are in order when stacked on a sheet ejection stack section even when data are to be recorded over plural pages and images thereof carried on the intermediate transfer device A4 are transferred onto the sheets. When the image forming apparatus is operated, the photo-conductive member A1 contacting the intermediate transfer device A4 starts rotating in the image formation section A. Thus, the image formation section A initially executes image formation. Due to operation of the exposure device A10 with the laser and polygon drive, a light beam having image data for yellow use is emitted to the surface of the photoconductive member A1 uniformly charged by the charge device A2 thereby a latent image is formed. The latent image is developed and visualized by the developing device A3, and is electrostatically transferred as a primary transfer onto the intermediate transfer device A4 by an operation of the transfer device A5, which moves in synchronism with the photoconductive member A1. Such latent image formation, the development, and the primary transfer operation are executed sequentially. As a result, respective color toner images of yellow, cyan, magenta, and black are superimposed in turn on the intermediate transfer device A4 to be a full color toner image. Then, the full color image is conveyed to a direction as shown by an arrow together with the intermediate transfer device A4. A sheet is simultaneously launched to be used for recording from a sheet cassette among the sheet feeding section B. A leading end of the sheet is timed and is conveyed to the transfer region. The full color toner image on the intermediate transfer device A4 is then transferred onto the sheet conveyed in synchronism with the intermediate transfer device A4. Then, the belt-cleaning device cleans the surface of the intermediate transfer device A4. The sheet with the toner images superimposed on the intermediate transfer device A4 is then conveyed toward the fixing device A8.

When subjected to a fixing operation with heat by the fixing device A8, the respective color toners superimposed on the sheet melt and are mixed, thereby perfectly becoming the full color image. At this moment, the fixing device A8 is capable of promptly heating so that productivity of image formation is improved. Even though plural numbers of printing are consecutively executed, a color image can be high quality.

Further, even if a size of a sheet is changed, an image can be obtained without offset or defective fixing.

In accordance with an image, power to be used by the fixing device A8 can be optimized by a controller.

Until a fixed toner firmly sticks to the sheet perfectly, a toner image sometimes drops or is disturbed due to rubbing of a guide member provided on a conveyance path or the like.

Thus, conveyance after fixing operation needs to attention.

Then, the sheet is ejected onto the ejected sheet storage section D by the sheet ejection roller with its image side facing downward. Pages of the sheets can be in order on the ejected sheet storage section D, because the sheets are stacked on the previous one in turn.

According to one embodiment of the present invention of the fixing device, since a width of heat generated by induction magnetic flux is controlled using plural demagnetizing coils, the width can be finely adjusted while avoiding complexity of the arrangement of the plural demagnetizing coils and maintaining a preferable distribution of the induction magnetic flux when the entire width is heated uniformly.

Further, a unit of an induction coil unit can be downsized. Further, a sheet having a prescribed size can be efficiently heated by turning on and off the demagnetizing coils.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A fixing device for fixing a toner image on a recordation medium, comprising:

a pair of rotation members, at least one of said pair of rotation members including a heat generation layer extending in parallel to an axis of one of the pair of rotation members; and a heat applying device arranged in the vicinity of one of the pair of rotation members, said heat applying device including;

an exciting coil configured to create a magnetic flux for generating induction heat in the heat generation layer, and at least two demagnetizing coils stacked in at least two layers partially overlying the exciting coil and configured to cancel the magnetic flux at least at one end of the pair of rotation members, said at least two demagnetizing coils being partially overlapping each other.

2. The fixing device as claimed in claim 1, wherein loop spaces formed in said at least two demagnetizing coils are substantially not interfered by the other one of the at least two demagnetizing coils.

3. The fixing device as claimed in claim 2, wherein said at least two demagnetizing coils include not less than three demagnetizing coils, wherein at least two of the not less than three demagnetizing coils are stacked substantially at the same distance from the surface of the one of the pair of rotation members.

4. The fixing device as claimed in claim 3, further comprising at least two central core members aligning on the same line in parallel to an axis of the at least one of the pair of rotation members within the loop spaces of said at least two demagnetizing coils, said central core member being made of magnetic material.

5. The fixing device as claimed in claim 4, wherein the size of the loop spaces of the at least two demagnetizing coils is different from each other.

6. The fixing device as claimed in claim 5, wherein said at least two demagnetizing coils are symmetrically arranged with respect to a widthwise center of the pair of rotation members, said at least two demagnetizing coils being electrically connected to each other.

7. The fixing device as claimed in claim 6, further comprising a control device configured to control calorie of said at least two demagnetizing coils by adjusting an amount of power to be supplied.

8. The fixing device as claimed in claim 7, wherein said control device includes a switching device for turning on and off the power.

9. The fixing device as claimed in claim 8, wherein said one of the rotation members includes one of a fixing roller and a fixing heat belt.

10. The fixing device as claimed in claim 8, wherein said one of the rotation members includes a heat applying roller, further comprising:

a fixing belt wound around the heat applying roller; and a fixing rotation member wound by the fixing belt together with the heat-applying roller.

11. An image formation apparatus, comprising:

an image bearer configured to carry a latent image;

a charge device configured to uniformly charge the surface of the image bearer;

an exposure device configured to write image data to form the latent image on the surface of the image bearer;

a developing device configured to visualize the latent image by applying toner;

a transfer device configured to transfer the visualized image onto a recordation medium;

a cleaning device configured to remove the toner remaining on the surface of the image bearer; and a fixing device configured to fix the toner onto the recordation medium, said fixing device including the fixing device as claimed in claim 10.

12. An image formation apparatus, comprising:

an image bearer configured to carry a latent image;

a charge device configured to uniformly charge a surface of the image bearer;

an exposure device configured to write image data to form a latent image on the surface of the image bearer;

a developing device configured to visualize the latent image by applying toner;

a transfer device configured to transfer the visualized image onto a recording medium; and a fixing device configured to fix the toner onto the recording medium, said fixing device including:

a pressure applying roller;

a fixing member including a heat generation layer extending in parallel to an axis of the pressure applying roller, the fixing member configured to be in contact with the pressure applying roller; and a heat applying device arranged in the vicinity of the fixing member, said heat applying device including:

an exciting coil configured to create a magnetic flux for generating induction heat in the heat generation layer; and at least two demagnetizing coils stacked in at least two layers partially overlying the exciting coil and configured to cancel the magnetic flux at least at one end of the fixing member in a direction parallel to the axis of the pressure applying roller, said at least two demagnetizing coils being partially overlapping each other.

13. The image formation apparatus as claimed in claim 12, wherein loop spaces formed in said at least two demagnetizing coils are substantially not interfered by the other one of the at least two demagnetizing coils.

14. The image formation apparatus as claimed in claim 13, wherein said at least two demagnetizing coils include not less than three demagnetizing coils, wherein at least two of the not less than three demagnetizing coils are stacked substantially at the same distance from the surface of the fixing member.

15. The image formation apparatus as claimed in claim 14, further comprising at least one central core member within at least one of the loop spaces of said at least two demagnetizing coils, said central core member being made of magnetic material.

16. The image formation apparatus as claimed in claim 13, wherein the size of the loop spaces of the at least two demagnetizing coils is different from each other.

17. The image formation apparatus as claimed in claim 12, wherein said at least two demagnetizing coils are symmetrically arranged with respect to a widthwise center of the fixing member, said at least two demagnetizing coils being electrically connected to each other.

18. The image formation apparatus as claimed in claim 12, further comprising a control device configured to control calorie of said at least two demagnetizing coils by adjusting an amount of power to be supplied.

19. The image formation apparatus as claimed in claim 12, wherein said fixing member is a fixing roller.

* * * * *